United States Patent [19]

Hirata

[11] 4,300,377

[45] Nov. 17, 1981

[54] DEVICE FOR WRAPPING STRIP PARTLY AROUND WORKING ROLLS OF ROLLING-MILL STAND

[75] Inventor: Hiromasa Hirata, Yokohama, Japan

[73] Assignee: Ishikawajima-Harima Jukogyo Kabushiki Kaisha, Japan

[21] Appl. No.: 162,623

[22] Filed: Jun. 24, 1980

[30] Foreign Application Priority Data

Jun. 28, 1979 [JP] Japan ..... 54/81773

[51] Int. Cl.[3] ..... B21B 39/16

[52] U.S. Cl. ..... 72/250; 72/205

[58] Field of Search ..... 72/250, 237, 205, 161, 72/241-243

[56] References Cited

U.S. PATENT DOCUMENTS 2,392,323 1/1946 Koss ..... 72/205 X

FOREIGN PATENT DOCUMENTS 579050 11/1977 U.S.S.R. ..... 72/205

*Primary Examiner*—Milton S. Mehr

*Attorney, Agent, or Firm*—B. B. Olive

[57] ABSTRACT

A device for automatically wrapping a strip of metal to be rolled partly around upper and lower working rolls in the form of S or inverted S in a safeguarded and simplified manner.

3 Claims, 8 Drawing Figures

DEVICE FOR WRAPPING STRIP PARTLY AROUND WORKING ROLLS OF ROLLING-MILL STAND

BACKGROUND OF THE INVENTION

In general, the new rolling-mill stands for rolling both ferrous and non-ferrous metals must fulfill the following requirements: (a) the rolling force must be low; (b) the rolled products have close tolerances; (c) the energy requirements must be low; (d) the rolling operations must be free from any external disturbance; and (d) the capital cost must be low. To these ends, there have been devised and demonstrated various types of "rolling drawing processes". A typical example is the so-called "full winding rolling process" in which a strip of metal to be rolled is wrapped around the working rolls in the form of an S or an inverted S so that the strip can be rolled by the frictional forces developed between the strip and the working rolls. However, this process has some defects. Firstly, the threading of a strip of metal through the working rolls must be made manually so that the threading operation is very hazardous and tedious as well. Secondly, in the case of a strip of a relatively great thickness, it is impossible to manually thread it through the working rolls. Furthermore in the case of the replacement of the working rolls, the strip must be cut off.

In view of the above, the present invention has for its object to provide a device for automatically threading a strip of metal to be rolled through the working rolls in the form of a letter S or inverted S in a positive and safeguarded manner within a very short time period. The present invention will become more apparent from the following description of a preferred embodiment thereof taken in conjunction with the accompanying drawings.

DETAILED DESCRIPTION OF THE PREFERRED EMBODIMENT

Figure 1:
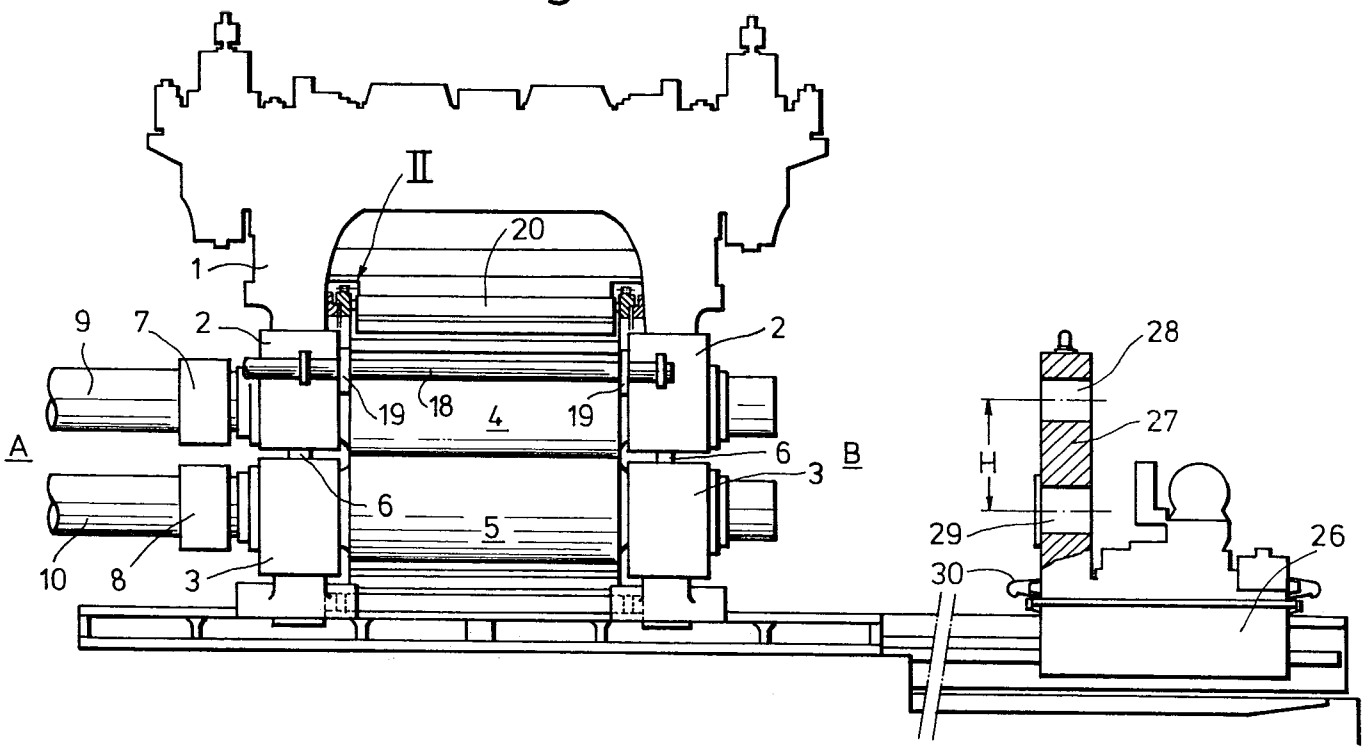
FIG. 1 is a front view of a rolling-mill stand to which is applied the present invention.
Figure 3:
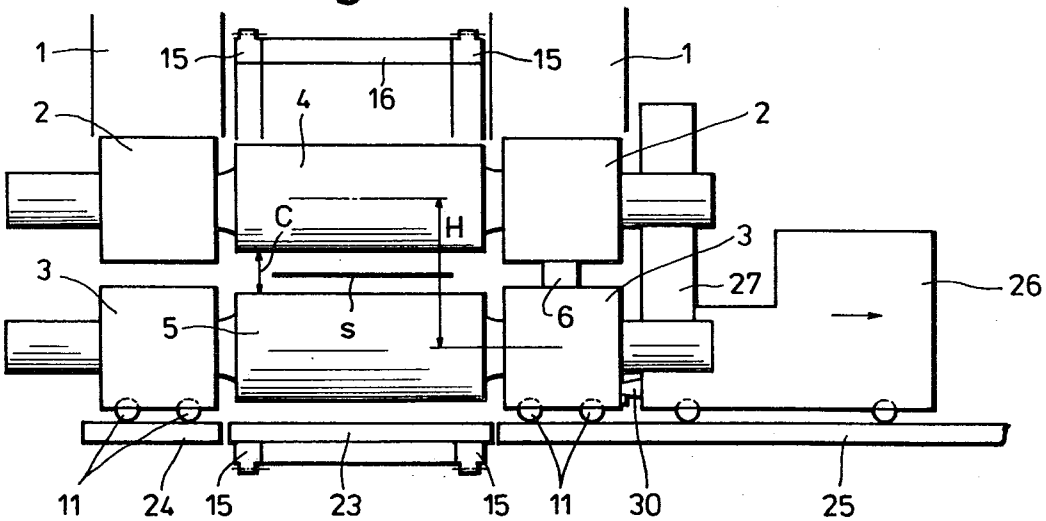
FIG. 3 is a view used for the explanation of the mode of operation for withdrawing both the upper and lower working rolls out of the rolling line.
Figure 4:
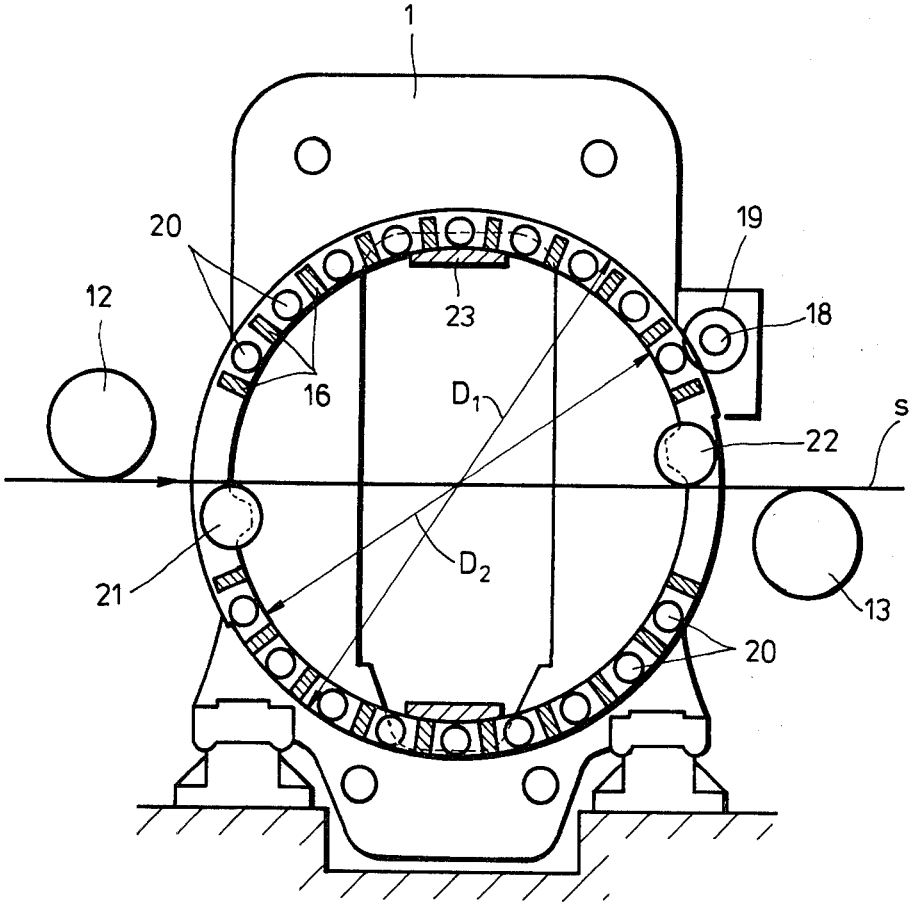
FIGS. 4(a) through (e) are views used for the explanation of the steps of wrapping or threading a strip of metal around or through the upper and lower rolls.
Figure 4:
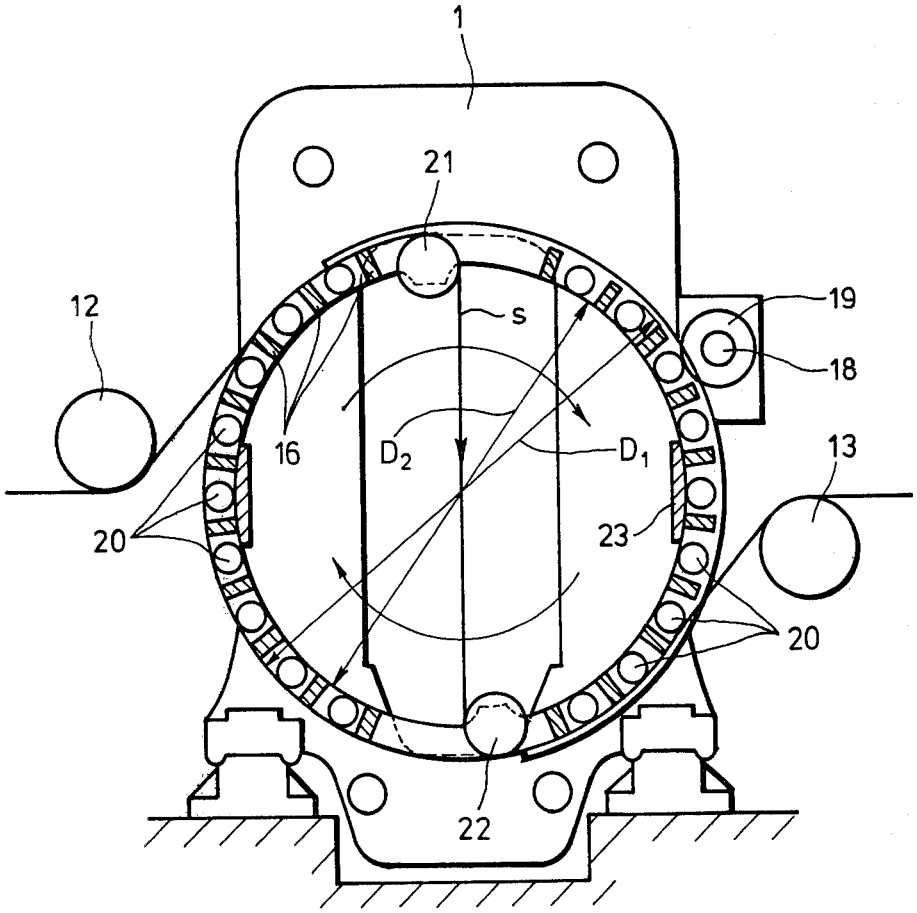
Figure 4:
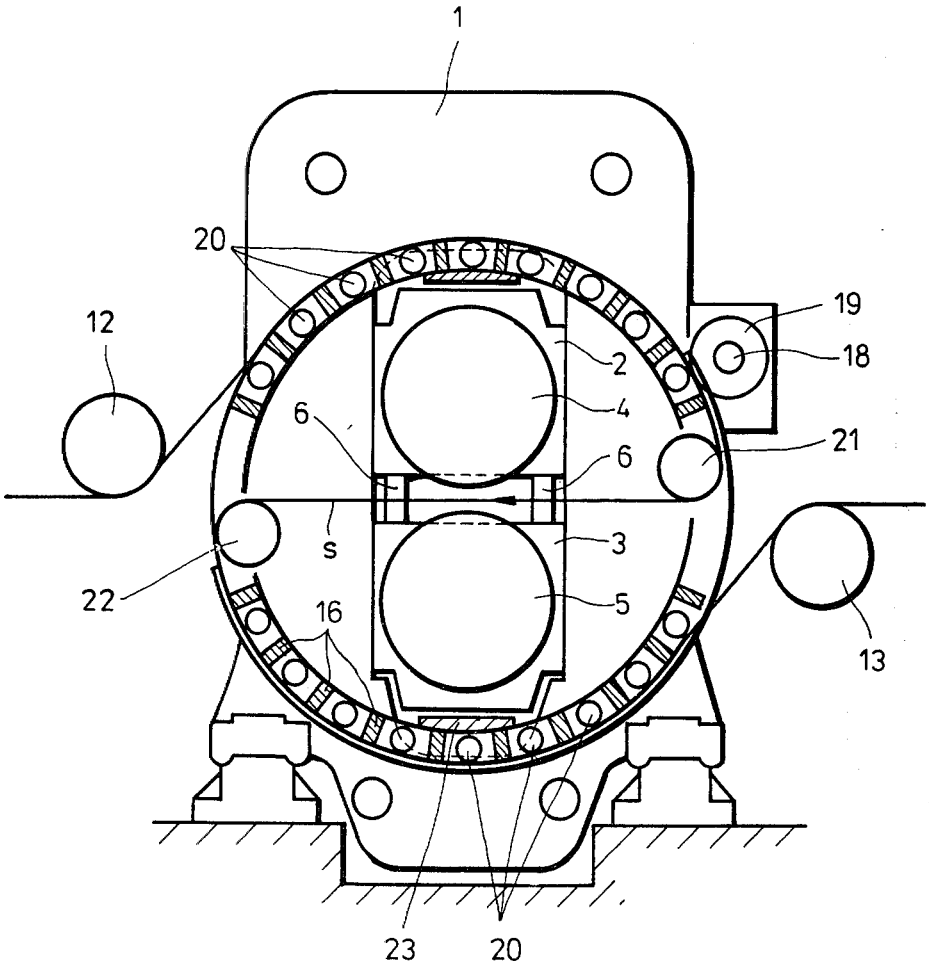
Figure 4:
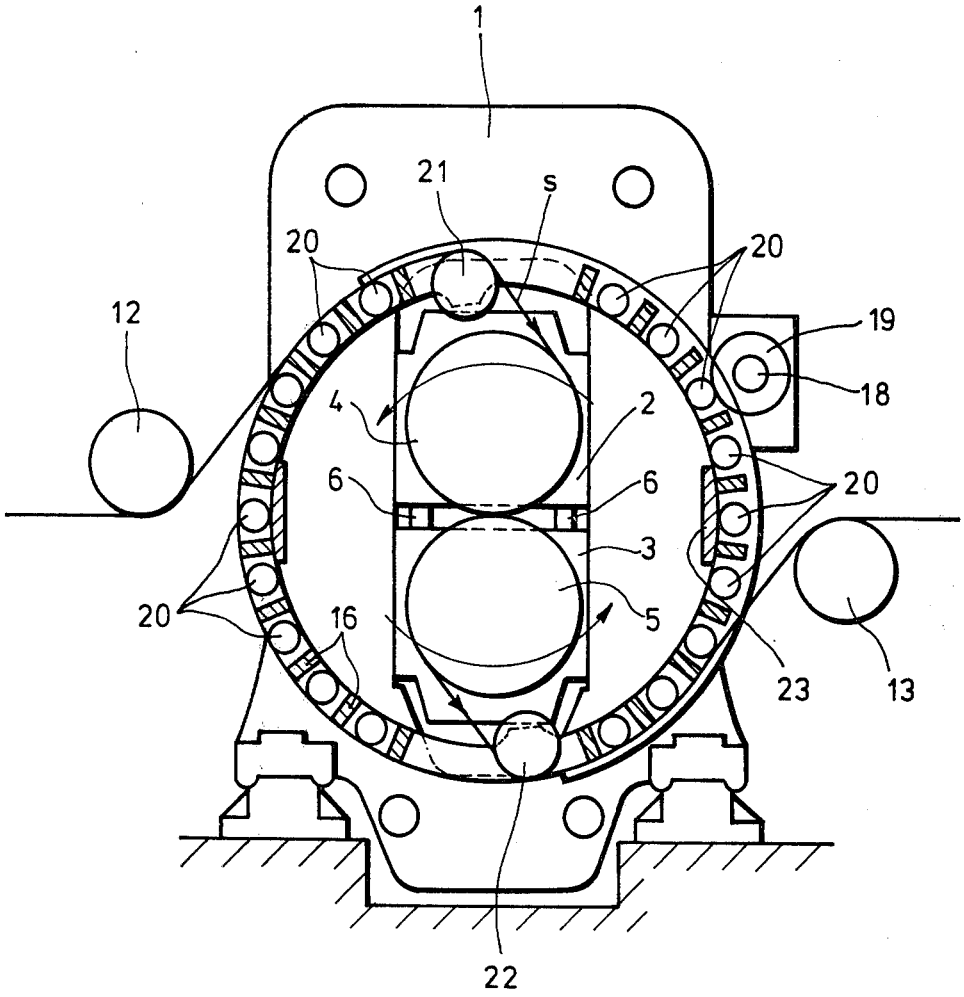
Figure 4:
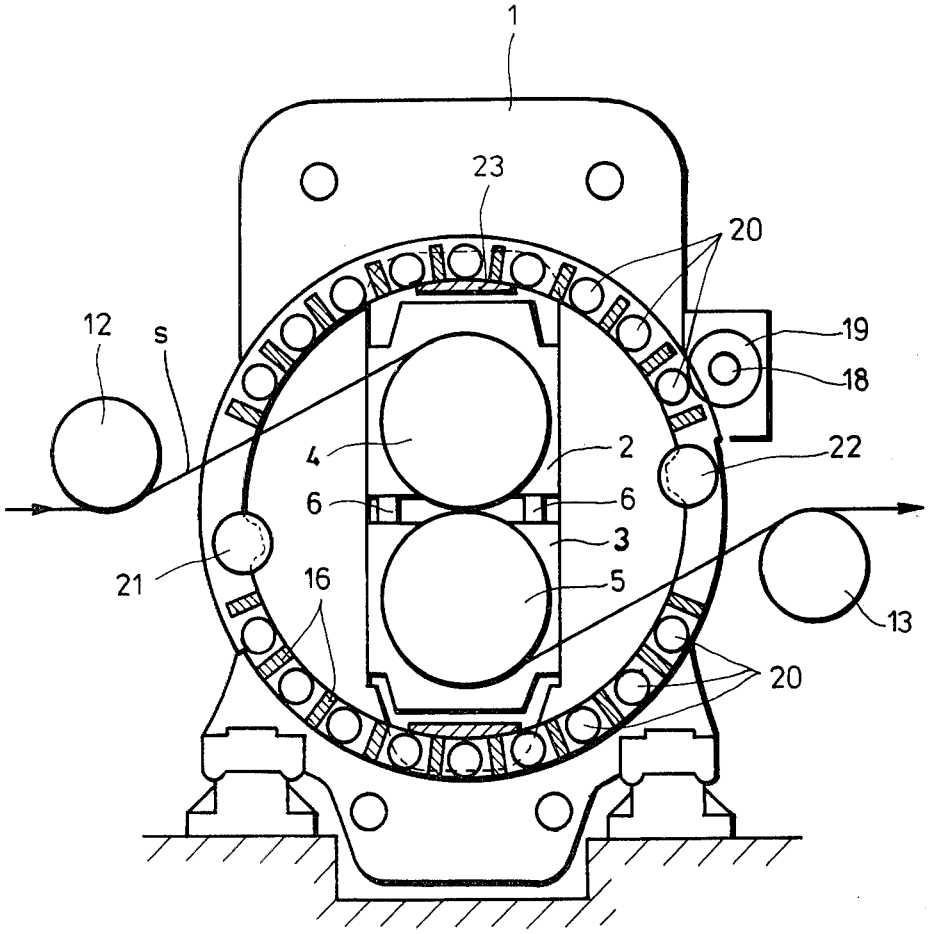

First referring to FIG. 1, upper and lower roll chocks 2 and 3 are detachably and vertically movably mounted on a housing 1, and an upper working roll 4 is supported by the upper roll chocks 2 while a lower working roll 5 by the lower roll chocks 3. Balance cylinders 6 are interposed between the upper and lower roll chocks 2 and 3. The upper and lower rolls 4 and 5 are connected through couplings 7 and 8, respectively, to shafts 9 and 10 which in turn are connected to prime movers (not shown). As shown in FIG. 3, the lower roll chocks 3 are provided with wheels 11 riding on rails 24 and 25 on the drive side A and the operation side B. As shown in FIG. 4, deflector rolls 12 and 13 are disposed upstream and downstream of the upper and lower rolls 4 and 5.

Figure 2:
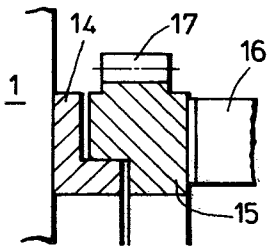
FIG. 2. is a detailed view of a portion indicated by II in FIG. 1.

Referring to FIG. 2, a ring-shaped guide 14 having an L-shaped cross sectional configuration is mounted on each of the inner walls of the housing 1, and a circular ring 15 is movably fitted into the ring-shaped guide 14. Both the circular rings 15 are rigidly interconnected with a plurality of transverse bracing members 16. Each circular ring 15 is provided with an array of externally threaded teeth 17 which is extended substantially one half (180°) of the circumferential periphery of the ring 15. The semicircular array of teeth 17 is in mesh with a pinion 19 carried by a drive shaft 18 which in turn is supported by the housing 1 in parallel with the working rolls 4 and 5 and is drivingly connected to a prime mover (not shown).

A plurality of rolls 20 of a small diameter are extended between the transverse bracing members 16 in parallel with them and are supported at ends by the circular rings 15. As best shown in FIG. 4, two rolls 21 and 22, which are diametrically spaced apart from each other, are also extended between the circular rings 15 between the upper and lower arrays of rolls 20. These rolls 20, 21 and 22 form a "bascket". As best shown in FIG. 4, rails 23 are securely attached to the inner peripheries of the circular rings 15 and angularly spaced apart from each other by substantially 180° and from the rolls 21 and 22 by substantially 90°.

Still referring to FIG. 4, the rolls 20, 21 and 22 internally touch a circle of a diameter $D_1$ while the rolls 20 outerly touch a circle of $D_2$. This diameter $D_1$ and the inner diameter of the circular ring 15 as well are determined in such a way that when the upper and lower roll chocks 2 and 3 together with the upper and lower working rolls 4 and 5 are removed out of or inserted into the housing 1, the upper and lower chocks 2 and 3 will not make any interference with the rolls 20, the circular ring 15 and the rails 23 thereon.

Referring back to FIGS. 1, 2 and 3 the rails 24 and 25 are extended transversely of the rolling-mill stand. A carriage 26 travels along the rails 25 and carries a block 27 having vertically spaced, working roll receiving holes 28 and 29 which have a diameter slightly greater than that of the working rolls 4 and 5 and are spaced apart from each other (center-to-center) by H. The carriage 26 is also provided with a pawl or hook 30 for engagement with the lower roll chock 3.

Next the mode of threading or wrapping a strip of metal will be described. The circular ring 15 is so rotated that the top of the roll 21 and the bottom of the roll 22 touch the passage S of the strip as shown in FIG. 4(*a*). Therefore the strip passes the bottom of the upstream deflector roll 12, the top of the roll 21, the bottom of the roll 22 and the top of the downstream deflector roll 13. Next the drive shaft 18 is driven so that the circular ring 15 is rotated in the clockwise direction to the position indicated in FIG. 4(*b*). The strip extends from the roll 21 to the roll 22 substantially vertically. The circular ring 15 is further rotated through 90° to the position shown in FIG. 4(*c*) in which the strip extends substantially horizontally from the roll 21 to the roll 22 and the rail 23 on the circular ring 15 bridges between the rails 24 and 25 as best shown in FIG. 3.

In the course of the threading operation, the working roll assembly must be inserted into the rolling-mill stand. The lower roll chocks 3 with the lower working roll 5 are placed on the rail 25 through the wheels 11. The lower working roll 5 (more specifically the journal portion thereof on the side of the carriage 26) is inserted into the hole 29 of the block 27 on the carriage 26. The pawl or hook 30 of the carriage 26 is engaged with the lower roll chock 3. The upper working roll 4 supported by the upper roll chocks 2 (more specifically the journal portion of the upper working roll 4) is inserted into the hole 28 of the block 27 in the carriage 26, and the balance cylinders 6 between the upper and lower roll chocks 2 and 3 on the operation side B are extended so that the upper working roll 4 is vertically upwardly moved away from the lower working roll 5 by a distance or spacing C as shown in FIG. 3. (The spacing between the axes of the working rolls 4 and 5 is H). Because the balance cylinders 6 on the drive side A have not been extended, the upper roll 4 is supported by the block 27 and the balance cylinders 6 like a cantilever. Thereafter the carriage 26 is moved into the rolling-mill stand so that the wheels 11 supporting the lower roll chock 3 ride along the rail 25, the rail 23 on the circular ring 15 and the rail 24. In this case, since the balance cylinders 6 on the drive side A have been withdrawn as described above, they will not interfere with the strip.

After the strip has been threaded as shown in FIG. 4(*c*), the working roll assembly carried by the carriage 26 is inserted into the rolling-mill stand in the manner as described above. Thereafter the balance cylinders 6 on the drive side A are extended so as to support the upper roll 4 at both ends thereof. Then the balance cylinders 6 on the operation side B and on the drive side A are somewhat withdrawn so that the journal portion of the upper working roll 4 is loosened in the hole 28. The pawl 30 is disengaged with the lower chock 3 and the carriage 26 is retracted in the direction indicated by the arrow in FIG. 3.

After the working roll assembly has been brought to its operative position as shown in FIG. 4(*c*), the balance cylinders 6 on the drive side A and on the operation side B are withdrawn so that the upper working roll 4 is lowered toward the lower working roll 5 and the strip S is clamped between them. Next the circular ring 15 is rotated in the counterclockwise direction so that the length of the strip between the rolls 21 and 22 is wrapped around the upper and lower rolls 4 and 5 as shown in FIG. 4(*d*). When the circular ring 15 is returned to its initial position, the strip is wrapped partly around the working rolls 4 and 5 in the form of inverted S as shown in FIG. 4(*e*) and is out of contact with the rolls 21 and 22. That is, after leaving the upstream deflector roll 12, the strip partly wraps the upper roll 4 substantially along the right half thereof and then the lower roll 5 substantially along the left half therof and extends straightly from the bottom of the lower roll 5 to the downstream deflector roll 13.

After the strip has been threaded in the manner described above, the upper and lower rolls 4 and 5 are connected through the couplings 7 and 8 to the drive shafts 9 and 10, respectively, whereby the rolling-mill stand is ready for rolling operation.

When the working roll assembly is replaced, the upper and lower rolls 4 and 5 are disconnected from the drive shafts 9 and 10. Next the circular ring 15 is rotated in the clockwise direction from the position indicated in FIG. 4(*e*) to the position shown in FIG. 4(*d*) and then to the position shown in FIG. 4(*c*). Thereafter the balance cylinders 6 on the drive side A and on the operation side B are extended so that the upper working roll 4 is vertically upwardly moved away from the lower roll 5 by a distance H (from center to center as shown in FIG. 3). The carriage 26 is moved toward the rolling-mill stand so that the journals of the upper and lower working rolls 4 and 5 are received in the holes 28 and 29, respectively, and the pawl or hook 30 is made into engagement with the lower roll chock 3 on the operation side B. The balance cylinders 6 on the drive side A are withdrawn so that they will not interfere with the strip S, and the carriage 26 is moved to the operation side B as indicated by the arrow in FIG. 3, whereby the working roll assembly is withdrawn out of the rolling-mill stand. Thereafter a new working roll assembly is inserted into the rolling-mill stand and the strip S is wrapped around the new working rolls in the manner described above with reference to FIGS. 4(*c*) through (*e*).

So far the present invention has been described in conjunction with the steps for wrapping the strip around the working rolls 4 and 5 in the form of an inverted S, but it is understood that the strip can be wrapped in the form of an S, that the rolls 21 and 22 can be eliminated among the rolls 20, 21 and 22 and that various modifications can be effected without leaving the true spirit of the present invention.

The novel effects, features and advantages of the present invention may be summarized as follows.

(I) Prior to the threading of the strip around the work rolls 4 and 5, it can be extended through the stand along a straight path of travel. As a result, the operation of passing a strip of metal through the rolling-mill stands can be simplified and safeguarded.

(II) Since the present invention can automatically wrap the strip around the working rolls, a strip of a relatively greater gage can be wrapped in a safeguarded manner.

(III) The replacement of a working roll assembly can be accomplished in a simple manner and within a very short time interval.

(IV) The strip can be passed through the rolling-mill stand even when the working roll assembly is being replaced so that the production line is not needed to be stopped. As a result, a high productivity can be ensured.

What is claimed is:

1. A device for wrapping a strip of metal partly around working rolls of a rolling-mill stand comprising
   circular rings each having an inner diameter large enough to permit the passage through said circular ring of an upper roll chock and a lower roll chock, said circular rings being rotatably mounted on a housing of said rolling-mill stand, a plurality of strip guide means extended between circular rings and angularly spaced apart along a circle coaxial with said circular ring, and
   deflector rolls disposed upstream and downstream, respectively, of said rolling-mill stand so as to deflect or guide a strip.
2. A device as set forth in claim 1 wherein
   said guide means comprise rolls.
3. A device as set forth in claim 1 or 2 wherein
   two guide rails for guiding a working roll assembly are extended between said circular rings and are angularly spaced apart by substantially 90° from two of said strip guide means that guide the strip diametrically across the circular rings.

* * * * *

UNITED STATES PATENT AND TRADEMARK OFFICE

CERTIFICATE OF CORRECTION

PATENT NO. : 4,300,377

DATED : November 17, 1981

INVENTOR(S) : Hiromasa Hirata

It is certified that error appears in the above—identified patent and that said Letters Patent is hereby corrected as shown below:

Col. 1, line 13, "(d)" should be --(e)--.

Col. 2, line 20, "bascket" should be --basket--.

Col. 2, lines 25-26, "internally" should be --externally--.

Col. 2, line 27, "outerly" should be --internally--.

Col. 2, line 27, "$D_1$" should be --$D_2$--.

Col. 3, line 4, "in" should be --on--.

Col. 4, line 33, "gage" should be --gauge--.

Signed and Sealed this

*Thirteenth* Day of *April 1982*

[SEAL]

*Attest:*

GERALD J. MOSSINGHOFF

*Attesting Officer*

*Commissioner of Patents and Trademarks*